US006779290B1

(12) United States Patent
Houtsma

(10) Patent No.: US 6,779,290 B1
(45) Date of Patent: Aug. 24, 2004

(54) SEMI PERMANENT BACKUP IRON SIGHT

(75) Inventor: Gary J. Houtsma, Denville, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 108 days.

(21) Appl. No.: 10/064,872

(22) Filed: Aug. 26, 2002

(51) Int. Cl.[7] ..... F41G 1/06; F41G 1/28
(52) U.S. Cl. ..... 42/148; 42/111
(58) Field of Search ..... 42/148, 106, 111

(56) References Cited

U.S. PATENT DOCUMENTS

| | | | | | |
|---|---|---|---|---|---|
| 878,857 | A | * | 2/1908 | Bevier | 42/136 |
| 2,093,676 | A | * | 9/1937 | Hennessy | 42/136 |
| 3,568,324 | A | * | 3/1971 | Jorczak | 42/142 |
| 3,604,137 | A | * | 9/1971 | Silsby | 42/137 |
| 3,882,609 | A | * | 5/1975 | Troutman | 42/124 |
| 4,016,652 | A | * | 4/1977 | Stratman | 42/137 |
| 5,533,292 | A | * | 7/1996 | Swan | 42/123 |
| 6,442,883 | B1 | * | 9/2002 | Waterman et al. | 42/124 |
| 6,622,415 | B1 | * | 9/2003 | Canaday et al. | 42/140 |

* cited by examiner

*Primary Examiner*—Charles T. Jordan
*Assistant Examiner*—Bret Hayes

(74) *Attorney, Agent, or Firm*—Robert Charles Beam; Michael C. Sachs; John F. Moran

(57) ABSTRACT

A semi permanent backup iron sight is adapted for attachment to, and detachment from a weapon while other devices are still attached to the weapon. The iron sight comprises a base formed of two vertical rails and an interconnecting member that allows the base to flex for securing the iron sight on the weapon; a sight aperture assembly formed of a sight aperture, a sight aperture frame, a sight aperture spring, and a sight aperture pivot pin; an elevation cam assembly formed of an elevation cam, a retaining clip, an elevation cam spring and keeper, and a detent spring and a ball detent; and a windage mechanism. The base provides a mounting interface for the sight aperture assembly, elevation cam assembly, and windage mechanism. The elevation cam assembly has an elevation scale located in a position that allows the shooter to see the elevation scale without moving his or her head from the shooting position. The elevation cam assembly has a limited range of rotation to preclude inadvertently over rotating the elevation cam assembly during low light and/or high stress conditions.

13 Claims, 4 Drawing Sheets

SEMI PERMANENT BACKUP IRON SIGHT

FEDERAL RESEARCH STATEMENT

BACKGROUND OF INVENTION

1. Field of the Invention

The present invention relates to rifle sights, and particularly to removable iron sights. More specifically, the present invention relates to semi permanent backup iron sight.

2. Background of the Invention

Numerous detachable iron sights designs have been proposed, among which are the following:

U.S. Pat. No. 4,461,087 to Norman, titled "Foldable Peep Sight;"

U.S. Pat. No. 4,092,793 to Ricks, titled "Clip-On Sight Mount;" and

U.S. Pat. No. 4,008,536 to Adams, titled "Detachable Gun Sight."

Weapons such as the M16A4 Rifle and M4 Carbine with integral mounting rails for fire control and other devices are typically employed with a M68 red dot optic sight as the primary fire control device. The M68 mounts to the weapon through the use of a quick release rail grabber.

The current iron sight used as a backup to the M68 red dot sight also uses a quick release rail grabber configuration to attach to the mounting rail on the weapon. The size and configuration of the current detachable iron sight does not allow the iron sight and the M68 red dot sight to be mounted on the weapon at the same time.

A great and still unsatisfied need exists for a semi permanent backup iron sight that can be mounted and used on the weapon while the M68 red dot sight is still mounted on the weapon. A need also exists for a semi permanent backup iron sight that can be mounted and used on the weapon while other devices are also mounted on the weapon.

SUMMARY OF INVENTION

One feature of the present invention is to satisfy this long felt need to provide a quick attach/detach rail grabber backup iron sight that fits on the weapon while other devices are also attached to this weapon. This feature is accomplished by a folding sight that provides clearance for mounting various ancillary pieces of equipment to the rifle with the backup iron sight attached.

Another feature of the present invention is the use of a torsion spring to hold the sight aperture in the open position while allowing the sight aperture to move when a force is applied to it. This reduces the potential for damage to the sight aperture during rough handling.

Still another feature of the present invention is the use of an interference fit between the sight aperture and the sight aperture frame to act as a detent for positively holding the sight aperture in the closed, folded, or stowed position. Placing the sight aperture in the stowed position further reduces the number of parts required compared to a conventional mechanism, where the detent function would normally include several additional elements.

An additional feature of the present invention is the positioning of the elevation readings so that they are directly observable from the shooting position.

Another feature of the present invention is the use of an elevation adjustment mechanism in the form of a cam. The cam is designed to limit adjustment of the elevation mechanism to preclude inadvertently over rotating the elevation adjustment mechanism. This feature greatly reduces the potential for setting the elevation at other than the desired setting.

BRIEF DESCRIPTION OF DRAWINGS

The various features of the present invention and the manner of attaining them will be described in greater detail with reference to the following description, claims, and drawings, wherein reference numerals are reused, where appropriate, to indicate a correspondence between the referenced items, and wherein:

The sizes of the different components in the figures may not be in exact proportion, and are shown only for visual clarity and for the purpose of explanation.

DETAILED DESCRIPTION

Figure 1:
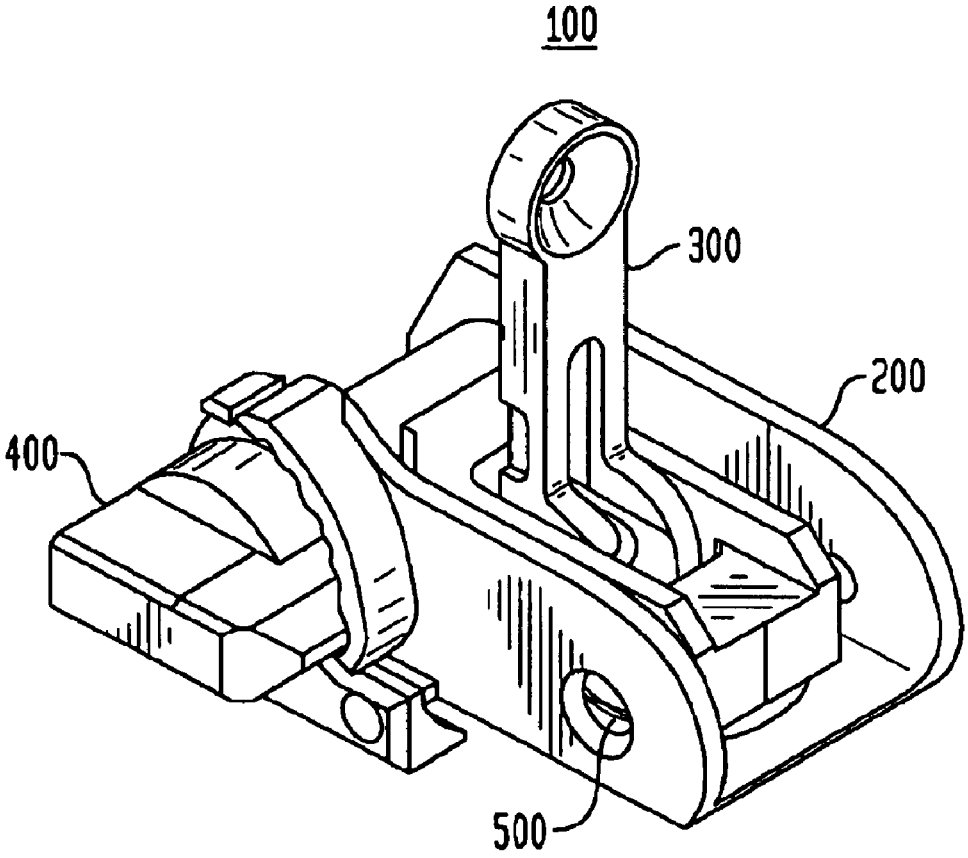
FIG. 1 is a left rear elevation view of the backup iron sight.

A backup iron sight 100 according to a preferred embodiment of the present invention is depicted in FIGS. 1 through 5. FIG. 1 shows four main components of the backup iron sight 100, they are: a base 200, a sight aperture assembly 300, an elevation cam assembly 400, and a windage mechanism 500.

Figure 2:
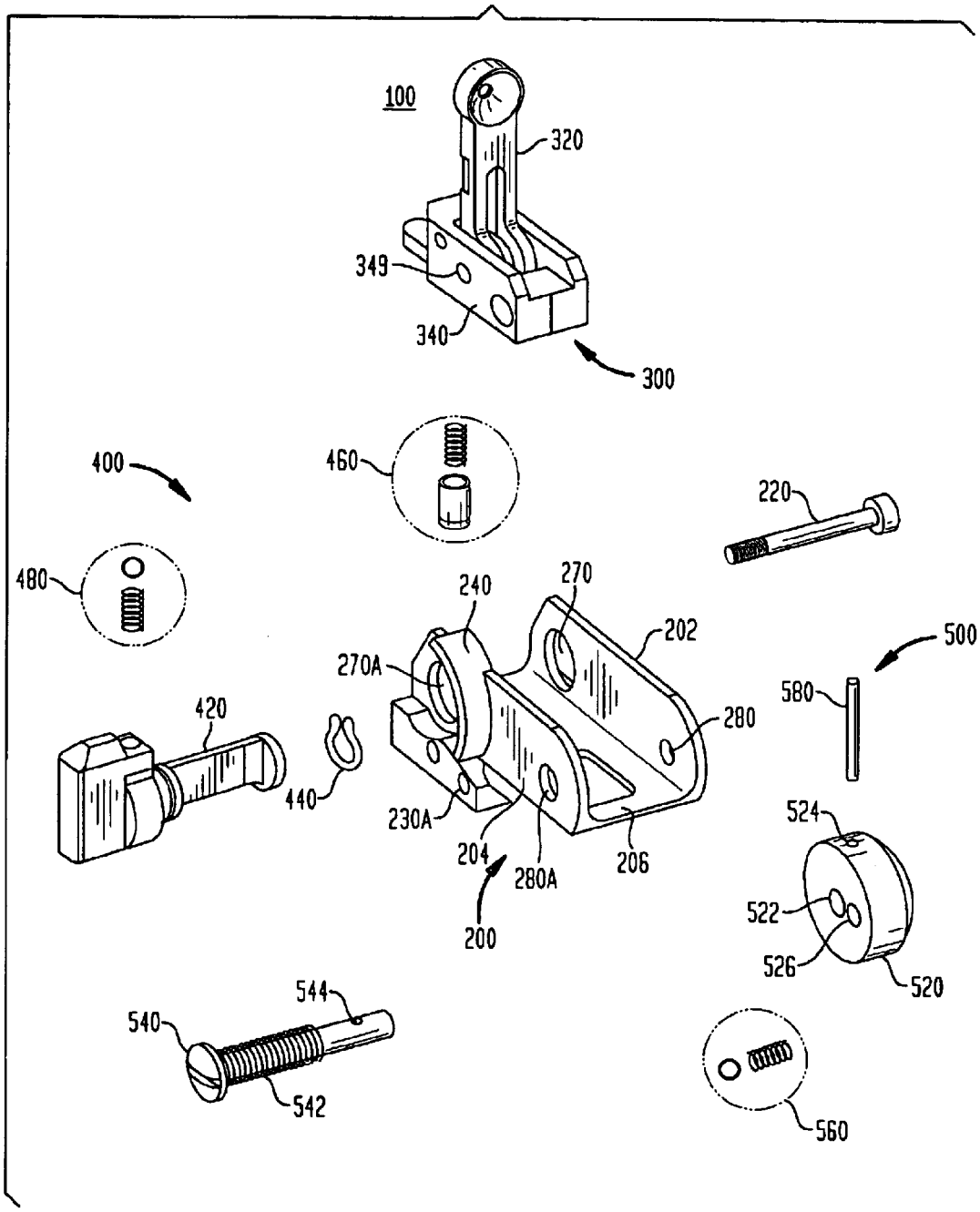
FIG. 2 is an exploded view of the backup iron sight of FIG. 1.
Figure 3:
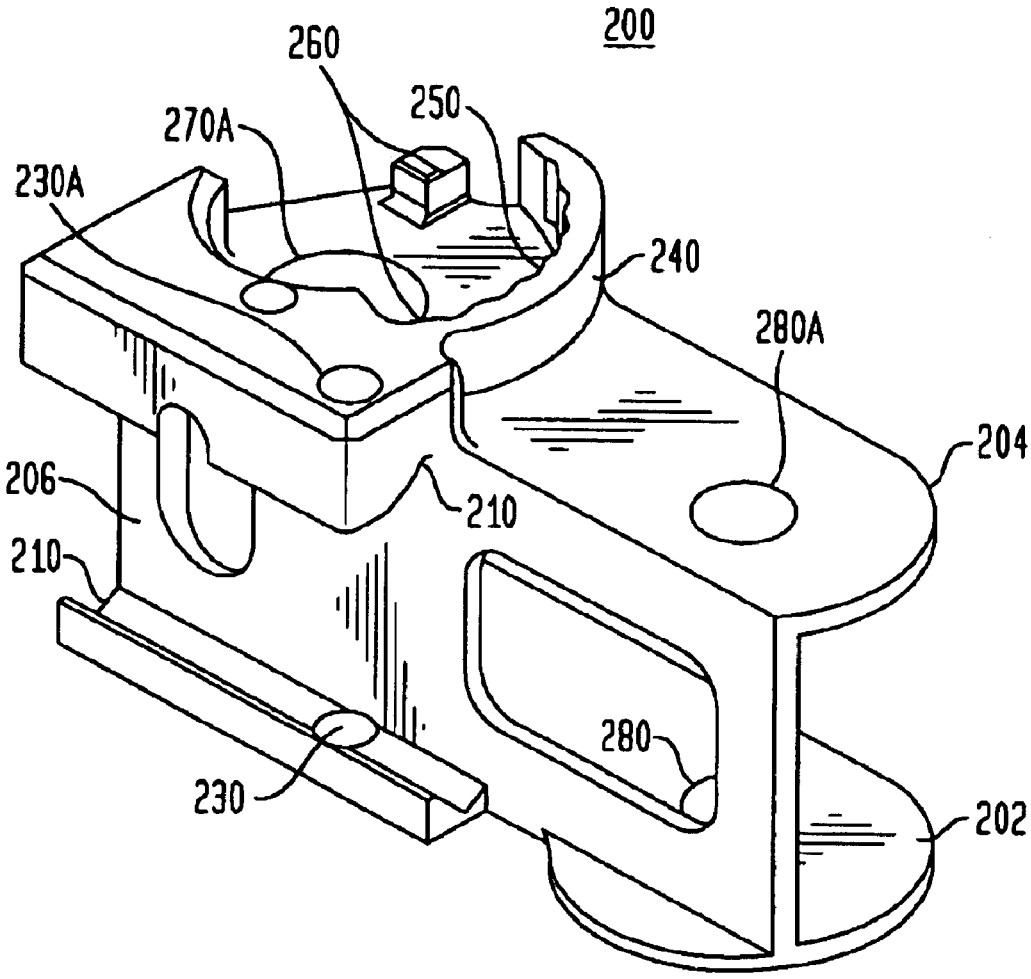
FIG. 3 is a left side bottom elevation view of a sight base of the backup iron sight of FIGS. 1 and 2.

With further reference to FIGS. 2 and 3, the base 200 provides the mounting interfaces for the sight aperture assembly 300, elevation cam assembly 400, and windage mechanism 500. The base 200 is configured as two vertical rails 202, 204 connected together with thin cross section members 206 above the "V" shaped weapon mounting interfaces 210. The thin section members 206 joining the vertical rails 202, 204 allow the base 200 to flex sufficiently to slide the weapon mounting interfaces over the corresponding mounting rail on the weapon.

Protruding from the left side of the base 200 is a curved flange 240 that has range markings (not shown) on the rearward facing (outside) surface, and indentations 250, corresponding to the range markings, within the forward facing (inside) surface. Also on the left side are stop surfaces 260 that limit the allowable rotation of the elevation cam 420 (FIG. 2).

A recoil screw 220 (FIG. 2) is assembled through a hole 230 in the right mounting interface and threaded into a corresponding hole 230A through the left mounting interface. Tightening the recoil screw 220 pulls the weapon mounting interfaces against the mounting rail on the weapon to firmly attach the backup iron sight to the weapon.

The base 200 also features two mounting holes 270, 270A for the elevation cam 420, and mounting holes 280, 280A for the windage adjustment screw 540 (FIG. 2). Not shown are a plurality of indentions located radially around the windage adjustment screw hole 280 on the right side. These indentations function in conjunction with the windage detent ball and spring 560 (FIG. 2) to index rotation of a windage knob 520 (FIG. 2).

Figure 4:
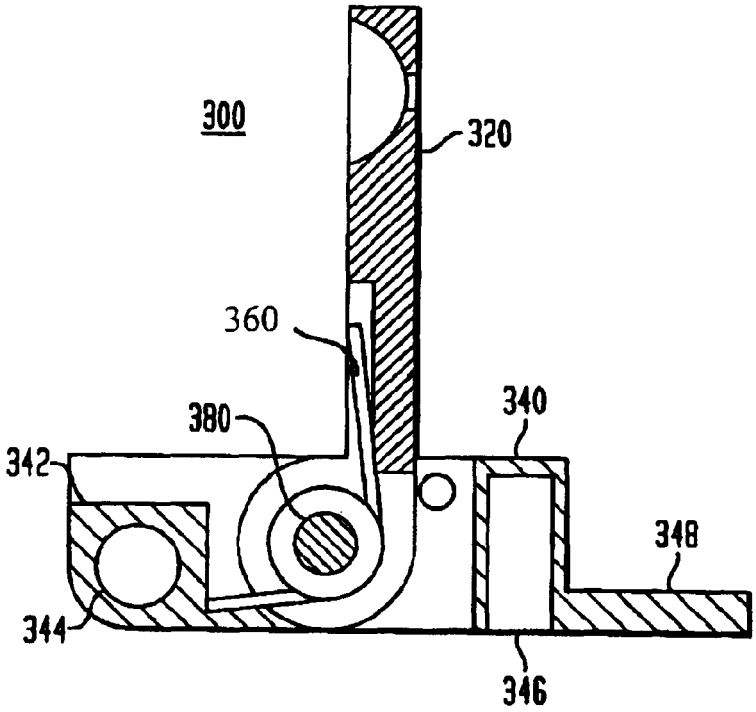
FIG. 4 is a left side section view of the sight aperture assembly of the backup iron sight of FIGS. 1 and 2, depicting the sight aperture in the up, open, or ready to use position.
Figure 5:
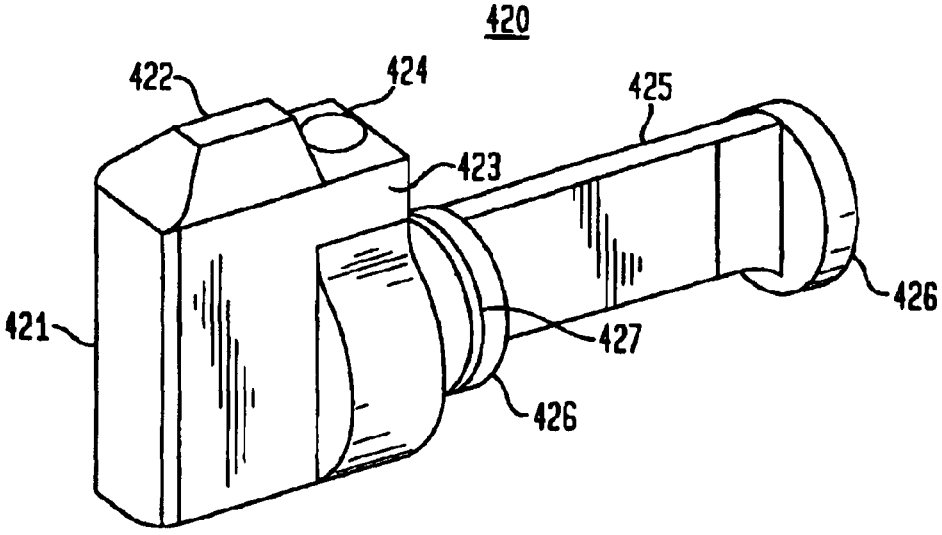
FIG. 5 is a left side elevation of the elevation cam of the backup iron sight of FIGS. 1 and 2.

With reference to FIGS. 1, 2, and 4, the sight aperture assembly 300 comprises a sight aperture 320, a sight aperture frame 340, a sight aperture spring 360, and a sight aperture pivot pin 380. Functional features of the frame 340 include: a raised surface 342 that functions as a stop for the sight aperture in the stowed (folded down) position; a threaded hole 344 that interfaces with the windage screw 530 (FIG. 2); a cavity 346 that interfaces with the elevation cam spring and keeper 460 (FIG. 2); a tang 348 that functions as a follower for the elevation cam 420 (FIG. 2); and a hole 349 (FIG. 2) through both sides that interfaces with a pivot pin 380.

The inner surfaces of the frame above raised surface 342 are sized to provide an interference fit between the sight aperture 320 and the sight aperture frame 340. This interference fit holds the sight aperture in the folded down or stowed position.

The outside width of the sight aperture frame 340 and the inside distance between the two vertical rails 202, 204 of the sight base 200 are sized to allow windage movement to the left or right of center when the sight aperture assembly 300 is assembled to the sight base 200. The sight aperture spring 360 is a torsion spring held in assembly by the sight aperture pivot pin 380. This spring functions between the sight aperture 320 and the sight aperture frame 340 to hold the sight aperture 320 upright when it is moved to that position. Further, the sight aperture spring 360 allows the sight aperture 320 to move when a load is applied to reduce the potential for sight component breakage during rough handling.

The elevation cam assembly 400 is comprised of the elevation cam 420, a retaining clip 440, an elevation cam spring and keeper 460, and a detent spring and a ball detent 480 (FIG. 2). The elevation cam 420 is configured with a knob 421, (FIG. 5), on the left side, the elevation cam section 425 along the midsection, and circular bearing surfaces 426 on both sides of the cam section 425.

The top of the knob 421 is chamfered on three sides forming a narrow flat surface 422 that indicates the chosen range setting marked on the sight base flange 240 (FIG. 3). Flat surfaces on both sides at the top interface 423 with the stop surfaces 260 (FIG. 3) in the sight base to limit the total allowable rotation of the elevation cam 420.

The detent spring and ball detent 480 (FIG. 2) are assembled in a hole 424 (FIG. 5) in the knob 421. Functionally, the detent spring pushes the ball detent into the indentations 250 (FIG. 3) in the sight base 200 to hold the elevation cam at the desired range position.

The cam section 425 is formed as a curved camming surface with a flat on one side, which allows assembly of the aperture assembly 300 (FIG. 2) to the base 200. Bearing surfaces 426 fit into corresponding holes 270, 270A (FIG. 2) in the sight base, and the retaining clip 440 (FIG. 2) is assembled in the annular groove 427 in the left bearing surface to hold the elevation cam assembly 400 within the sight base 200.

The elevation cam spring and keeper 460 (FIG. 2) fit within a cavity in the sight aperture frame 346 (FIG. 4), and act against the inside bottom of sight base 200. This action forces the tang 348 on sight aperture frame 340 (FIG. 4) against the camming surface 425 of the elevation cam 420 (FIG. 5), thus raising or lowering the sight aperture 320 as the knob 421 is rotated.

The windage mechanism 500 is comprised of: a windage knob 520, a windage screw 540, windage detent ball and spring 560, and a windage knob retaining pin 580 (FIG. 2). The windage screw 540 is assembled through mounting holes 280, 280A (FIG. 3) in the sight base 200, with the threaded midsection 542 also assembled through the threaded hole 344 (FIG. 4) in the sight aperture frame 340 (FIG. 4).

The reduced diameter right side of the windage screw 540 extends beyond the right side of the sight base 200, and fits into a hole 522 in the windage knob 520. Windage screw retaining pin 580 is assembled through a hole 524 in the windage knob 520 and hole 544 at the end of the windage screw 540, to captivate the windage mechanism 500 to the base 200.

The windage detent ball and spring 560 are assembled in a third hole 526 in the windage knob, functioning in conjunction with the indentations in the right side of the sight base 200 to index rotation of the windage knob 520. Thus assembled, the windage adjustment screw 540 secures the sight aperture assembly 300 to the right or the left in response to rotation of the windage adjustment knob 520.

The embodiments described herein are included for the purposes of illustration, and are not intended to be the exclusive; rather, they can be modified within the scope of the invention. Other modifications may be made when implementing the invention for a particular application.

What is claimed is:

1. A semi permanent iron sight adapted for attachment to, and detachment from a weapon, by providing a clearance for one or more devices to be secured to the weapon, comprising:

a base formed of two vertical rails and an interconnecting member that allows the base to flex for securing the iron sight on the weapon;

a sight aperture assembly formed of a sight aperture, a sight aperture frame, a sight aperture spring, and a sight aperture pivot pin;

an elevation cam assembly formed of an elevation cam, a retaining clip, an elevation cam spring and keeper, and a detent spring and a ball detent; and p1 a windage mechanism, wherein the base provides a mounting interface for the sight aperture assembly, elevation cam assembly, and windage mechanism.

2. The iron sight of claim 1, further comprising an elevation adjustment mechanism with an elevation scale.

3. The iron sight of claim 2, wherein the elevation adjustment mechanism includes a cam mechanism that has a limited range of rotation to preclude inadvertent over rotation.

4. The iron sight of claim 1, wherein the elevation cam assembly includes a knob.

5. The iron sight of claim 1, wherein the base includes a curved flange with range markings.

6. The iron sight of claim 5, wherein the base further includes stop surfaces that limit an allowable rotation of the elevation cam assembly.

7. The iron sight of claim 6, wherein the base further includes a recoil screw that is assembled through two holes in two opposed mounting interfaces, to firmly attach the iron sight to the weapon.

8. The iron sight of claim 1, wherein the windage mechanism comprises a windage knob.

9. The iron sight of claim 1, wherein the sight aperture spring is a torsion spring held in assembly by the sight aperture pivot pin.

10. The iron sight of claim 9, wherein the sight aperture functions between the sight aperture and the sight aperture frame to hold the sight aperture upright.

11. The iron sight of claim 8, wherein the windage mechanism further comprises a windage screw, a windage detent ball and spring assembly, and a windage knob retaining pin.

12. The iron sight of claim 11, wherein the windage screw is assembled through mounting holes in the base.

13. The iron sight of claim 12, wherein the windage detent ball and spring assembly is secured to the windage knob, to index rotation of the windage knob.

* * * * *